US010284326B2

(12) United States Patent
Erbes et al.

(10) Patent No.: US 10,284,326 B2
(45) Date of Patent: May 7, 2019

(54) PENALTY-BASED ENVIRONMENT MONITORING

(71) Applicant: TALEN-X, INC., Beavercreek, OH (US)

(72) Inventors: Tim Erbes, Ankeny, IA (US); Greg Gerten, Marysville, OH (US); Tyler Hohman, Columbus, OH (US); Gabe Johnson, Ankeny, IA (US)

(73) Assignee: TALEN-X, INC., Beavercreek, OH (US)

( * ) Notice: Subject to any disclaimer, the term of this patent is extended or adjusted under 35 U.S.C. 154(b) by 16 days.

(21) Appl. No.: 15/591,155

(22) Filed: May 10, 2017

(65) Prior Publication Data

US 2018/0331780 A1 Nov. 15, 2018

(51) Int. Cl.
*G08B 21/18* (2006.01)
*H04K 3/00* (2006.01)

(52) U.S. Cl.
CPC ..... *H04K 3/22* (2013.01); *G08B 21/182* (2013.01); *H04K 3/45* (2013.01)

(58) Field of Classification Search
CPC ..... H04K 3/22; H04K 3/45; G08B 21/182
See application file for complete search history.

(56) References Cited

U.S. PATENT DOCUMENTS 3,947,636 A * 3/1976 Edgar ..... H03G 3/345 327/100
5,130,994 A * 7/1992 Madey ..... H01S 3/0903 372/108
5,836,003 A * 11/1998 Sadeh ..... H03M 7/3084 341/51
6,219,373 B1 * 4/2001 Lee ..... G06F 17/148 375/130
6,313,789 B1 * 11/2001 Zhodzishsky ..... G01S 19/29 342/357.68
6,760,663 B2 * 7/2004 Brenner ..... G01S 5/009 342/357.48
7,095,779 B2 * 8/2006 Karlsson ..... H03J 7/02 342/14
7,512,492 B2 3/2009 Irvin et al.
(Continued)

OTHER PUBLICATIONS

The MITRE Corporation; Time Anomaly Detection Applique (TADA); Copyrighted 2013.

*Primary Examiner* — Nay Tun
(74) *Attorney, Agent, or Firm* — Thomas E. Lees, LLC

(57) ABSTRACT

A system and process for determining a communication status of an environment is disclosed. Sensors in the environment acquire data about the environment, and a first subset of the data is used to compute a first penalty about the environment, which is computed using a first algorithm that includes a maximum penalty and a decay rate at which the penalty decays over time. Further, a second subset of the data is used to compute a second penalty about the environment. The second penalty is computed using a second algorithm that also includes a maximum penalty and a decay rate at which the penalty decays over time. The first and second penalties are compiled to create an overall environmental penalty that represents a current status of the environment, which is compared to a threshold. If the overall environmental penalty exceeds the threshold, then an action, including issuing an alarm, is performed.

17 Claims, 6 Drawing Sheets

(56) References Cited

U.S. PATENT DOCUMENTS

| | | | | |
|---|---|---|---|---|
| 7,881,725 | B2 * | 2/2011 | Rong | H04W 28/18 370/331 |
| 8,121,631 | B2 * | 2/2012 | Goia | H04B 17/309 455/522 |
| 8,743,854 | B1 * | 6/2014 | Fuemmeler | H04B 1/7107 370/342 |
| 8,800,036 | B2 * | 8/2014 | Khayam | H04L 63/1425 709/206 |
| 9,008,714 | B2 * | 4/2015 | Tokgoz | H04W 52/243 455/522 |
| 9,766,343 | B2 * | 9/2017 | Schleppe | G01S 19/21 |
| 2003/0114983 | A1 * | 6/2003 | Irvin | G01S 19/21 701/473 |
| 2004/0121808 | A1 * | 6/2004 | Hen | H04W 28/22 455/561 |
| 2004/0258035 | A1 * | 12/2004 | Fan | H04W 16/14 370/342 |
| 2006/0153281 | A1 * | 7/2006 | Karlsson | H03J 7/02 375/130 |
| 2010/0220615 | A1 * | 9/2010 | Enstrom | H04L 29/06027 370/252 |
| 2011/0185422 | A1 * | 7/2011 | Khayam | H04L 63/1425 726/23 |
| 2012/0329399 | A1 * | 12/2012 | Tokgoz | H04W 52/243 455/63.1 |
| 2015/0133182 | A1 * | 5/2015 | Tokgoz | H04W 52/243 455/522 |
| 2018/0074170 | A1 * | 3/2018 | Ray | G01S 7/2923 |

* cited by examiner

PENALTY-BASED ENVIRONMENT MONITORING

BACKGROUND

Various aspects of the present invention relate generally to a technological field of determining a communication status of an environment and more specifically to using multiple algorithms to determine the communication status of the environment.

Telecommunications includes transmitting data either wirelessly or through a wire. When communicating wirelessly, the data is placed on a carrier signal (e.g., radio frequency, light frequency, etc.) and transmitted through an environment to another location. If there is background noise in the environment, then the signal-to-noise ratio of the transmitted signal may be too high, and the data on the carrier signal may not be decoded correctly.

In some instances, entities will introduce artificial background noise into an environment to prevent wireless communications within that environment. Such a practice is referred to as jamming. Further, some entities may try to thwart or obfuscate proper communications through spoofing, in which the entity masquerades as the communication source by falsifying data.

BRIEF SUMMARY

According to aspects of the present invention, a system and process for determining a communication status of an environment is disclosed. Sensors in the environment acquire data about the environment, and a first subset of the data is used to compute a first penalty about the environment, which is computed using a first algorithm that includes a maximum penalty and a decay rate at which the penalty decays over time. Further, a second subset of the data is used to compute a second penalty about the environment. The second penalty is computed using a second algorithm that also includes a maximum penalty and a decay rate at which the penalty decays over time. The first and second penalties are compiled to create an overall environmental penalty that represents a current status of the environment, which is compared to a threshold. If the overall environmental penalty exceeds the threshold, then an action, including issuing an alarm, is performed.

DETAILED DESCRIPTION

According to aspects of the present disclosure, systems and methods are disclosed for determining a communications status of an environment (e.g., whether the environment is being jammed, spoofed, etc.). Data from several sensors are used by multiple algorithms to determine the status of the communications environment. Outputs from the algorithms are compiled to give an overall penalty score for the environment. Then, based on that overall penalty score, reports, alarms, logs, etc. may be logged and send to a remote server.

Figure 1:
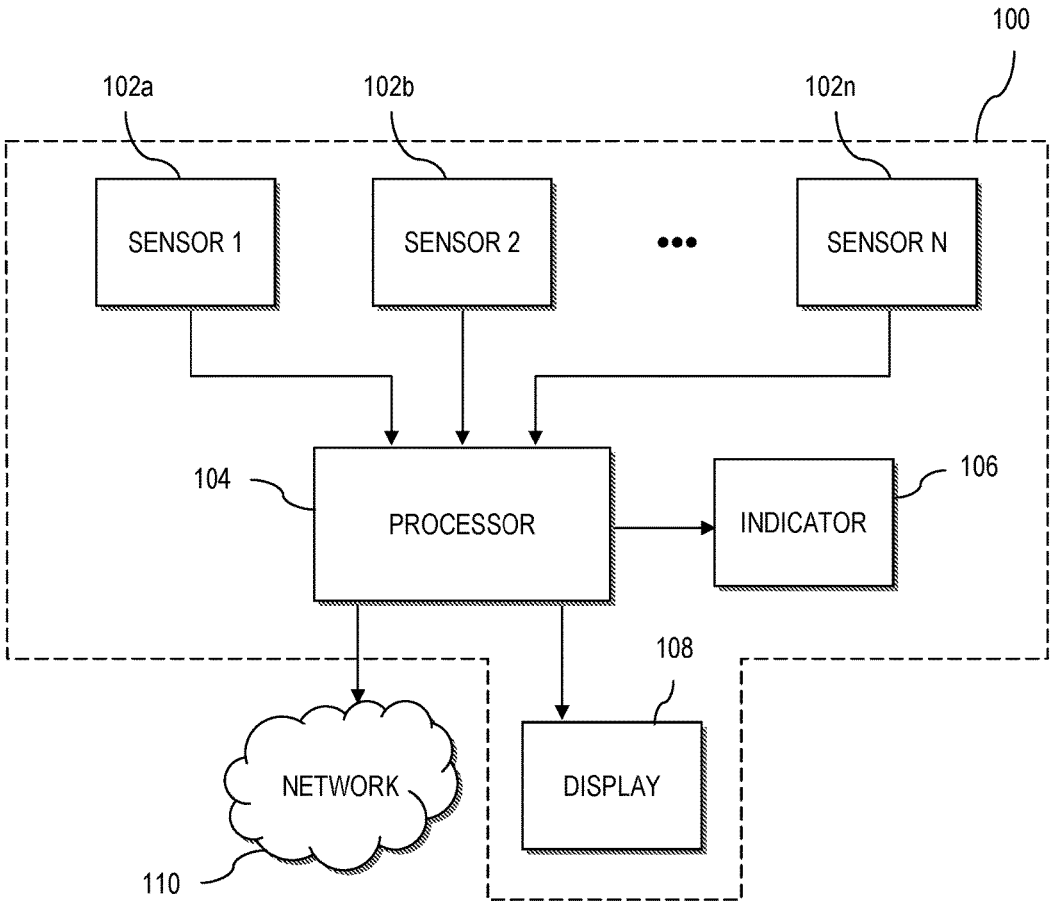
FIG. 1 is a block diagram of a system for penalty-based environment monitoring, according to various aspects of the present disclosure.

Referring to drawings and in particular FIG. 1, a block diagram for a system 100 for determining the communication status of an environment using a penalty-based method is shown. The system 100 includes several sensors 102*a-n* that may be any type of sensors or combinations of sensors. For example, the sensors 102*a-n* may be global navigation satellite system (GNSS) receivers that receive information from satellites and then may pass that information on to a processor 104. As another example, the sensors may be selective availability anti-spoofing module (SAASM GPS (global positioning system)) receivers. As other examples, the sensors may be: modernize GPS user equipment (MGUE) receivers, inertial measurement units (IMU), inertial navigation sensors (INS), spectrum analyzers, or anti-jam controlled electronic radiation pattern antennae. Further, the sensors 102*a-n* may be any combination of the sensors mentioned above or other sensors.

The sensors may be co-located or may be disposed separately from each other to obtain separate readings. However, each sensor 102 should be present within the environment that they are measuring/receiving data. The sensors 102*a-n* communicate with a processor 104 to provide data to the processor 104 to run algorithms that help determine the status of the environment. For example, the sensors 102*a-n* may send the data through a wired connection, a wireless connection, or both (e.g., two sensors communicate through a wired connection, while five sensors communicate wirelessly).

In turn, the processor 104 runs the algorithms on the data from the sensors to provide penalties based on the data. For example, the data from two sensors 102 may be used in one algorithm to calculate a first penalty, while data from another set of sensors (or a single sensor) may be used to calculate a second penalty. Thus, the penalties are created by the algorithms using subsets of the available data from the sensors. Then the processor 104 may use both of those penalties to calculate an overall penalty that describes a possible issue with communications within the environment.

As such, the system 100 may detect anomalies in the communications of an environment. For example, the system 100 may detect that someone is jamming communications (i.e., introducing increased environment noise) or spoofing communications (i.e., someone masquerading as a true communications source) through the use of multiple algorithms creating penalty values and then adding the penalty values from the multiple algorithms to create a total penalty score. The use of algorithms to compute an overall penalty score is described in greater detail below.

When the penalty score exceeds a threshold, a warning is issued. For example, the processor 104 may send a signal to an indicator 106 (e.g., light, buzzer, etc.) that activates to issue the warning. As another example, the processor 104 may send a warning for display on a display 108 coupled to the processor. A further example includes the processor 104 issuing the warning over a network 110 to a server, display, indicator, etc., or combinations thereof. Any or all of the issued warning examples described above may be used separately or in combination.

Moreover, the system 100 may be physically configured in many ways. For example, the system 100 may be rack mounted. This way, the system 100 may be networked into existing system racks to monitor and protect timing equipment. As another example, the system 100 may be integrated directly into existing or new devices (e.g., military equipment, vehicles, timing receivers, commercial GPS receivers, etc.). Further, the system 100 may be self-contained such that a user may transport the system 100 to any location.

In any of the configurations, the sensors 102*a-n* may be collocated with the processor 104, may be located separately from the processor, or both (e.g., some sensors located with the processor 104 and some located elsewhere).

Figure 2:
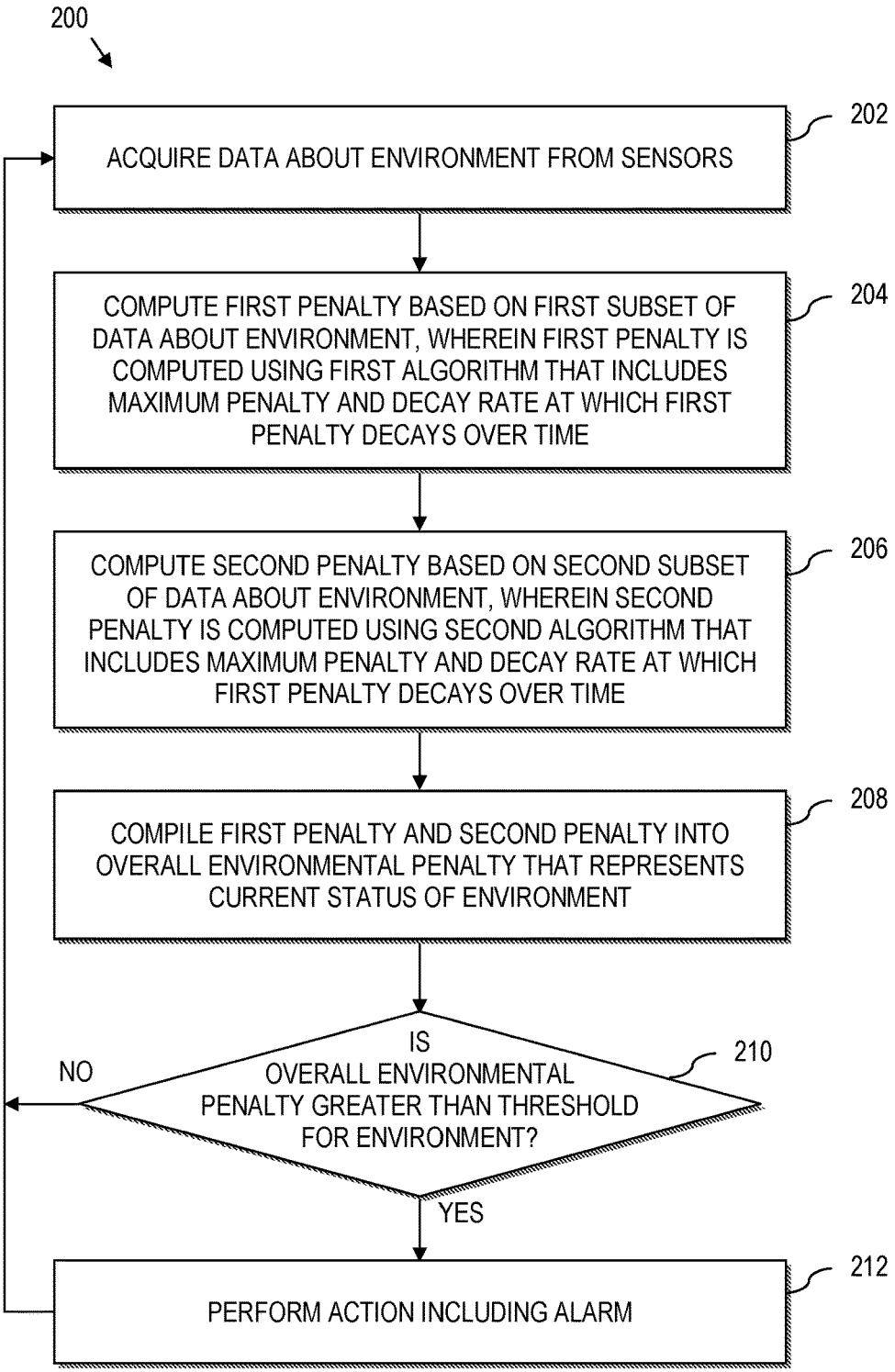
FIG. 2 is a flow chart illustrating a method for penalty-based monitoring to determine a communications status of an environment, according to various aspects of the present disclosure.

Referring now to FIG. 2, a method 200 for determining a communication status of an environment using a penalty-based system is presented. In this regard, the method 200 may be implemented on computer-readable hardware that stores machine-executable program code, where the program code instructs a processor to implement the described method. The method 200 may also be executed by a processor coupled to memory, where the processor is programmed by program code stored in the memory, to perform the described method. While the blocks of the method 200 described herein are in a specific order, the blocks may be performed in an order different than FIG. 2 indicates. Also, some of the blocks may be performed in parallel.

At 202, data about an environment is acquired by receiving data from sensors within the environment. As stated above, the sensors may be global navigation satellite system (GNSS) receivers, selective availability anti-spoofing module (SAASM GPS (global positioning system)) receivers, modernize GPS user equipment (MGUE) receivers, inertial measurement units (IMU), inertial navigation sensors (INS), spectrum analyzers, anti jam controlled electronic radiation pattern antennae, other sensors, or combinations thereof.

At 204, a first penalty is computed by running a subset of the data acquired from the sensors through an algorithm. In other words, a first penalty is computed based on a first subset of the data about the environment, wherein the first penalty is computed using a first algorithm that includes a maximum penalty. For example, if the first subset of data is outside a predetermined range, then a penalty is assigned based on how far the data is outside the predetermined range. However, the penalty may be capped at a maximum penalty value.

In some embodiments, the first algorithm further includes a decay rate that causes the penalty to decay over time, unless the first subset of data is still outside the predetermined range. For example, if the computed value is fifty and the decay rate is five per second, then the penalty will decay by five every second (unless the data is still outside the predetermined range). The decay rates and maximum values are described in greater detail below in reference to FIG. 3.

At 206, a second penalty is computed by running a second subset of the data acquired from the sensors through a second algorithm. In other words, a second penalty is computed based on a second subset of the data about the environment, wherein the first penalty is computed using a second algorithm that includes a maximum penalty. Similar to the first penalty, if the second subset of data is outside a predetermined range, then a penalty is assigned based on how far the data is outside the predetermined range. However, the penalty may be capped at a maximum penalty value. Also, the second algorithm may include a decay rate, similar to the first algorithm.

The first algorithm and the second algorithm may be the same algorithm that processes different subsets of data. On the other hand, the same subset of data may be processed by two different algorithms. As another example, the first algorithm and second algorithm may be different algorithms processing two different subsets of data. Further, the decay rates may be the same for both algorithms, or the decay rates may be different.

As shown in FIG. 2, the method 200 includes two algorithms for calculating penalties. However, there may be more algorithms included to provide more individual penalty scores.

At 208, the computed penalty scores are compiled into an overall environmental penalty. The penalty scores may be compiled in any desired way. For example, there may be a straight addition of the first penalty and the second penalty. Further, there may be a weighted addition of the first penalty and the second penalty. Moreover, there may be some other function or algorithm to compile the computed penalty scores into the overall environmental penalty.

At 210, the overall environmental penalty is compared to a threshold. If the overall penalty exceeds the threshold, then at 212 an action is performed. For example, an alarm (i.e., warning) may be issued locally, over a network, or both. In the system of FIG. 1, the alarm may be issued via the indicator, the display, over the network, or combinations thereof. Other actions may include determining that an apparatus associated with the environment is in a jammed state, a spoofed state, or both; disabling an output of a device (e.g., a GNSS device, a SAASM GPS device, etc.); placing the device in a sleep, deactivated, or low power mode; clearing position, velocity, and time information of the device; disabling an antenna; creating a report; or combinations thereof. If the overall penalty stops exceeding the threshold (or a second threshold if a buffer is used), then any actions that were performed may be reversed automatically, upon command, or both.

If, at 210, the overall penalty does not exceed the threshold, then the process loops to 202.

For a penalty to exceed a threshold, the penalty must be on a side of the threshold opposite of an acceptable side. For example, if the threshold is one-hundred and the acceptable side is anything less than one-hundred, then a penalty of ninety does not exceed the threshold, but a penalty of one-hundred-and-ten does exceed the threshold. On the other hand, if the threshold is one-hundred and the acceptable side is anything greater than one-hundred, then a penalty of ninety exceeds the threshold, but a penalty of one-hundred-and-ten does not exceed the threshold.

Further, there may be different thresholds for comparison to the overall penalty score. Thus, when the different thresholds are exceeded, the system will perform different actions.

The penalty-based method 200 for determining a status of an environment allows for a more aggressive detection technique while preventing false alarms. For example, each detection of an issue counts as a unique instance and contributes to an overall penalty score. Thus in some embodiments, one spike from one algorithm may not be enough to exceed the threshold, so no action is performed. However, in some embodiments several small penalties, when compiled, may be enough to exceed the threshold, so an action is performed. This provides an advantage over existing solutions, because false alarms (e.g., in the form of spikes) may be prevented.

Further, the decay rates allow for less frequent data to be as valuable as more frequent data, while still providing less of an impact on the overall system. For example, if one sensor provides data at a slow rate and another sensor provides data at a much higher rate, the data from both sensors are just as valuable to the overall penalty without causing the slower sensor to override the faster sensor.

Figure 3:
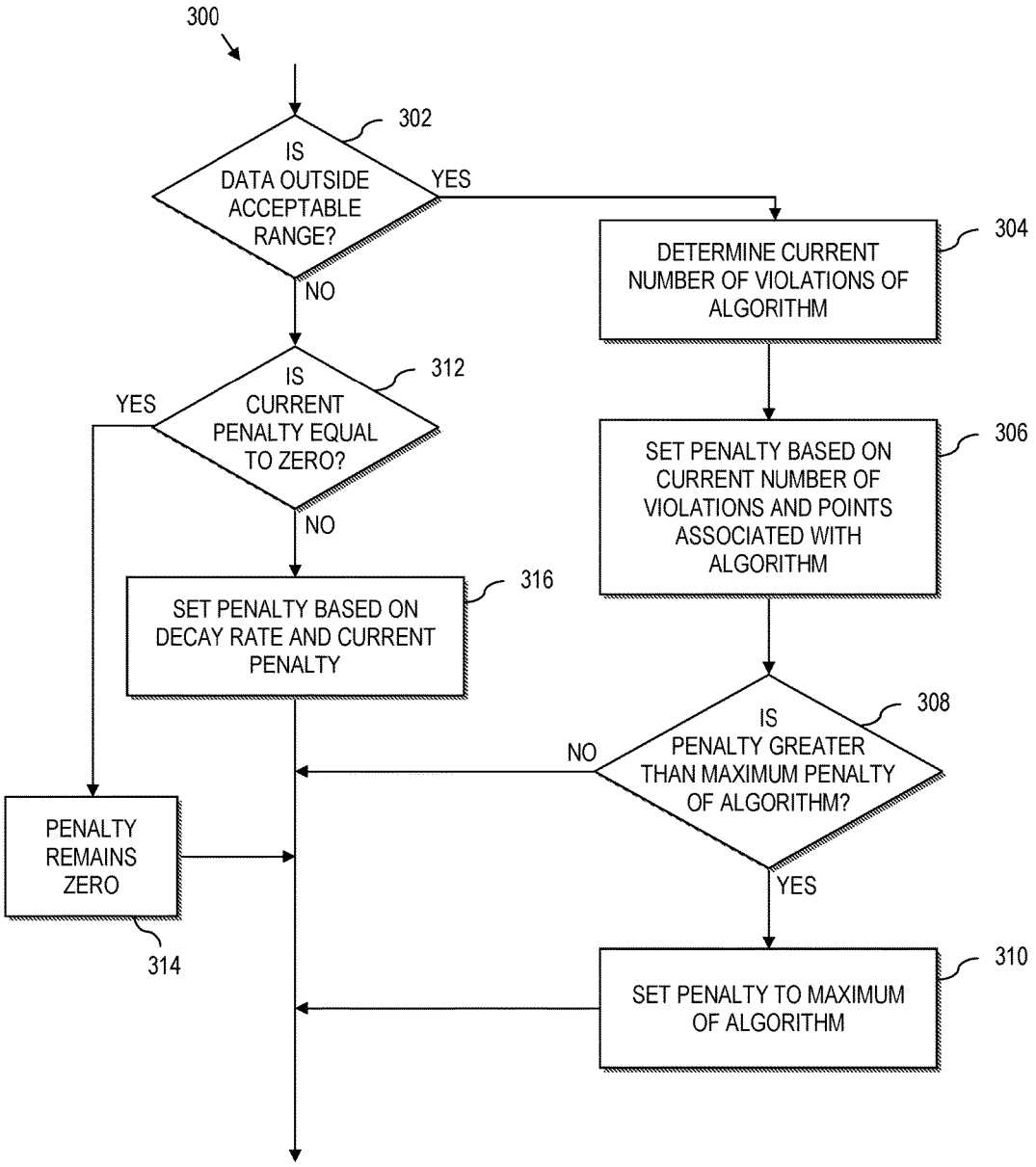
FIG. 3 is a flow chart illustrating a method for setting a penalty in penalty-based monitoring to determine a communications status of an environment, according to various aspects of the present disclosure.

Referring now to FIG. 3, a method 300 for applying a maximum penalty and a decay rate to an algorithm is shown. As with the method of FIG. 2, the method 300 may be implemented on computer-readable hardware that stores machine-executable program code, where the program code instructs a processor to implement the described method. The method 300 may also be executed by a processor coupled to memory, where the processor is programmed by program code stored in the memory, to perform the described method. While the blocks of the method 300 described herein are in a specific order, the blocks may be performed in an order different than FIG. 3 indicates. Also, some of the blocks may be performed in parallel. The method 300 may be used as a portion of one of the computing blocks (204, 206) of FIG. 2.

At 302, there is a determination of whether the subset of data being used for by the algorithm is outside an acceptable range. If so, then at 304, there is a determination of a severity of the data being outside the acceptable range (e.g., a number of sensors are outside the acceptable range, how many orders of magnitude the data is outside the acceptable range, etc.).

At 306, the penalty is set based on the severity of the data being outside the acceptable range and a point value associated with the algorithm. For example, if there are two of eighteen sensors outside the acceptable range, and each violation accounts for ten points, then the penalty is set to twenty (i.e., two times ten). As another example, if an algorithm is such that every order of magnitude the data is out of the acceptable range is worth ten points, then data that is three orders of magnitude outside the acceptable range has a penalty of thirty.

However, if the algorithm includes a maximum penalty, then at 308, the set penalty (from 306) is compared to the maximum penalty, and if the set penalty is not above the maximum penalty, then the penalty for the algorithm remains at the set penalty from 306. However, if the set penalty from 306 is greater than the maximum penalty, then at 310, the penalty for the algorithm is set to the maximum penalty for that algorithm. The maximum penalties prevent one algorithm from overpowering all of the other algorithms in the method of FIG. 2. Further, a similar process may be used if there is a minimum penalty associated with the algorithm.

If, at 302, the data is not outside the acceptable range, then at 312 there is a determination if the current penalty for the algorithm is equal to zero. If so, then the penalty remains zero at 314. However, if the current penalty is not zero (and the data is within the acceptable range), then at 316, the penalty is set based on the current penalty and the decay rate. For example, if the decay rate is five points per second and the current penalty is fifty, then if a second has passed since the last time the decay rate was used to calculate the penalty or since the data has been within the acceptable range, then the penalty is set to forty-five (i.e., the current penalty minus the decay rate).

The following example illustrates the use of methods 200 and 300 of FIGS. 2-3, respectively. A first algorithm has the following specification:

Acceptable range=3-6

Points if violated=10 per point outside the acceptable range

Maximum penalty=50

Decay Rate=10 points per 15 seconds

A second algorithm has the following specification:

Acceptable range=40-80

Points if violated=5 per point outside the acceptable range

Maximum penalty=50

Decay Rate=10 points per 30 seconds

The example system includes two sensors that supply data for use by the algorithms: a light sensor and a humidity sensor. The first algorithm concerns the sun's brightness in the environment, and the second algorithm concerns the humidity in the environment. When compiling the individual penalties from the algorithms, the penalties are simply added.

Following the method 200 of FIG. 2, at a certain point in time, the light sensor gives a value of ten and the humidity sensor gives a value of twenty. Thus, data is acquired about the environment (202, FIG. 2). The first algorithm is used to compute a first penalty (204, FIG. 2). In the present example, the first algorithm uses the light sensor and compares the data from the light sensor to the acceptable range (302, FIG. 3). The data is outside the acceptable range, so the severity of the violation is determined (304, FIG. 3) to be four (i.e., the absolute value of six (i.e., the maximum of the acceptable range for the first algorithm) minus ten (i.e., the data from the light sensor)). Thus, a penalty of forty (i.e., ten times four) is set (306, FIG. 3). Forty is less than the maximum penalty, so the penalty for the first algorithm is set to forty.

In the present example, the second algorithm (204, FIG. 2) uses the humidity sensor and compares the data from the humidity sensor to the acceptable range (302, FIG. 3). The data is outside the acceptable range, so the severity of the violation is determined (304, FIG. 3) to be twenty (i.e., the absolute value of forty (i.e., the minimum of the acceptable range for the second algorithm) minus twenty (i.e., the data from the humidity sensor)). Thus, a penalty of one-hundred (i.e., five times twenty) is set (306, FIG. 3). One hundred is greater than the maximum penalty, so the penalty for the second algorithm is set to fifty (i.e., the maximum penalty) (310, FIG. 3).

The penalties from the two algorithms are compiled (208, FIG. 2) to yield ninety (i.e., forty plus fifty). The threshold for the overall penalty in the present case is fifty, and ninety exceeds fifty (310, FIG. 3), so the system issues an alarm (212, FIG. 2).

After two minutes of being at the values above, the light sensor reads five, and the humidity sensor reads fifty. Thus, both algorithms are within their acceptable ranges. As such, every fifteen seconds that the light sensor remains within that acceptable range, the penalty decays by ten. Further, every thirty second that the humidity sensor remains within that acceptable range, the penalty decays by ten. Thus, after fifteen seconds, the overall penalty is reduced to eighty. After thirty seconds, the overall penalty is reduced to sixty. After forty-five seconds, the overall penalty is reduced to fifty and is finally not exceeding the threshold of fifty, so the system stops issuing the alarm.

The preceding example is a simplified example and not meant to be limiting. Further, other algorithms and ways to compute penalties and compile the penalties may be used.

As mentioned above, any number of algorithms may be used and compiled to create the overall penalty.

The systems and methods described above may be used for any desirable application to determine the communication status of an environment. For example, the systems and methods may be used to detect GNSS jamming by monitoring GNSS frequency bands (e.g., using separate algorithms for each frequency band) for elevated noise levels and comparing GNSS receiver signal tracking statistics against noise observed in the environment. Using conventional methods, a technique like this would have an unacceptably high probability of a false alarm; however, combining this comparison with other observables (e.g., historical known data from communications satellites, GPS and GNSS simulator data, etc.) can reduce the likelihood of a false alarm. Further, the type of jamming occurring in the environment may be classified by monitoring any detected waveform.

Figure 4:
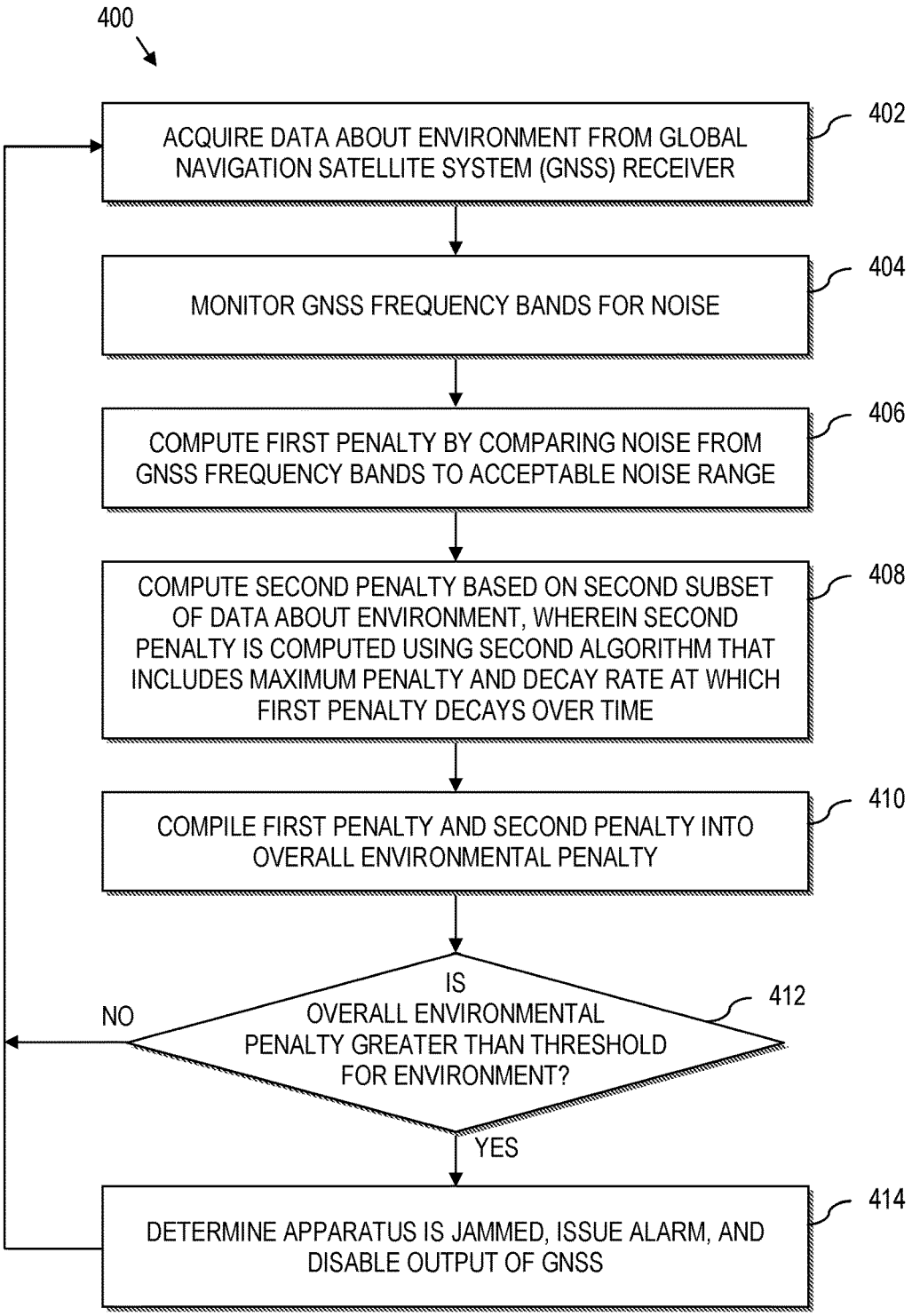
FIG. 4 is a flow chart illustrating an example of determining a communications status of an environment to detect jamming, according to various aspects of the present disclosure.

FIG. 4 is a flow chart that illustrates a method 400 for detecting GNSS jamming. At 402, data about the environment is acquired from GNSS sensors or other sensors, as mentioned above.

At 404, GNSS frequency bands (e.g., 1559-1610 MHz, 1151-1214 MHz, etc.) are monitored for noise. For example, the acquired data about the environment may be compared to known good data about the environment to determine if there is noise at the GNSS frequency bands. One technique to determine if there is noise is to subtract the known good data from the acquired data, which would result in the noise present on the band. Another technique that may be used includes automatic gain control values on the GNSS sensors (i.e., GNSS receiver) to automatic gain control in known acquired waveforms. Another technique can be used to detect wideband jamming by comparing total input power with a normal total input power specification.

At 406, a first penalty is computed by using one of the techniques listed above or some other technique. For example, the first penalty may be based on comparing the noise from the GNSS frequency bands to an acceptable noise range. Further, the first penalty may include a decay rate, as discussed above, At 408, a second penalty is computed based on a subset of data about the environment, wherein second penalty is computed using a second algorithm that includes maximum penalty and decay rate at which second penalty decays over time. For example, the second penalty may be based on a comparison of the gain control value of the GNSS against automatic gain control in known acquired waveforms. Again, the second penalty includes a decay rate as discussed above.

At 410, the first penalty and second penalty are compiled into an overall environmental penalty. For example, the first penalty may be added to the second penalty.

At 412, a determination is made on whether the overall environmental penalty exceeds a threshold for the environment. If not, the method 400 loops back to 402. If so, then at 414 it is determined that the GNSS apparatus is jammed, an alarm is issued, and the GNSS output is disabled.

Figure 5:
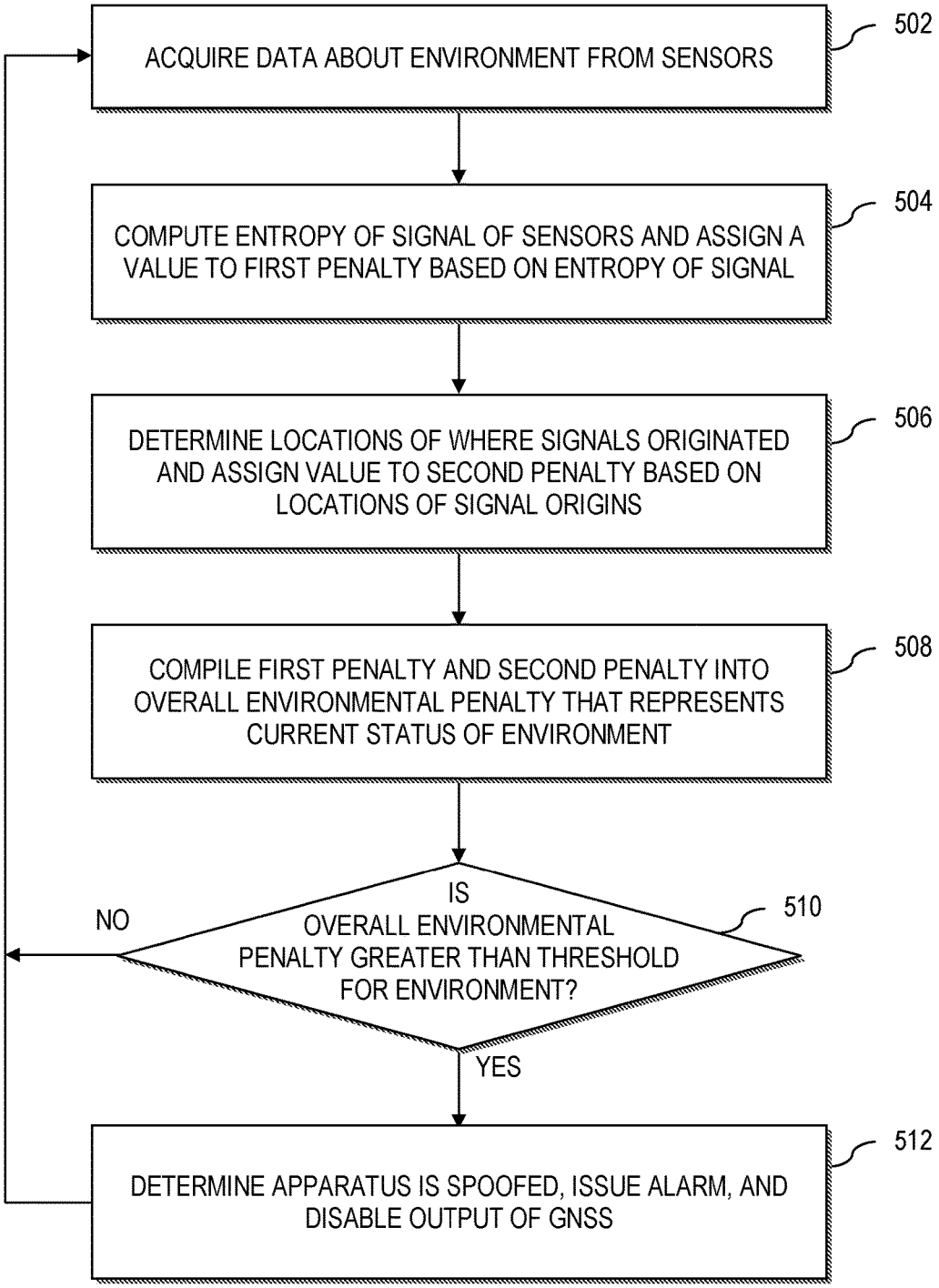
FIG. 5 is a flow chart illustrating a second example of determining a communications status of an environment to detect spoofing, according to various aspects of the present disclosure.

As another example, the systems and methods described herein may be used to detect spoofing by combining data from several different sensors. For example, current entropy measurements may be compared with historical entropy measurements; measurements of phase Doppler, power, or combinations thereof; discontinuous clock observations; or combinations thereof. FIG. 5 illustrates a sample method 500 for detecting spoofing in an environment.

At 502, information about the environment is acquired from sensors within the environment.

At 504, a first penalty is computed using entropy values from the sensors. For example, a higher entropy usually means that there is no spoofing, but a lower entropy may indicate that there is spoofing. Thus, an algorithm for the first penalty may include that the penalty is inversely proportional to the entropy in the environment. As above, the first penalty may also include a decay rate.

At 506, a second penalty is based on reported locations of origins of signals detected by the sensors. If those origins match known locations, then there is no penalty, but if those origins do not match the known locations, then a non-zero penalty may be calculated. As above, the second penalty may also include a decay rate.

At 508, the first and second penalties are compiled into an overall environmental penalty. At 510, a determination is made on whether the overall environmental penalty exceeds a threshold for the environment. If not, the method 500 loops back to 502. If so, then it is determined that spoofing is present in the environment, an alarm is issued, and the GNSS output is disabled.

Figure 6:
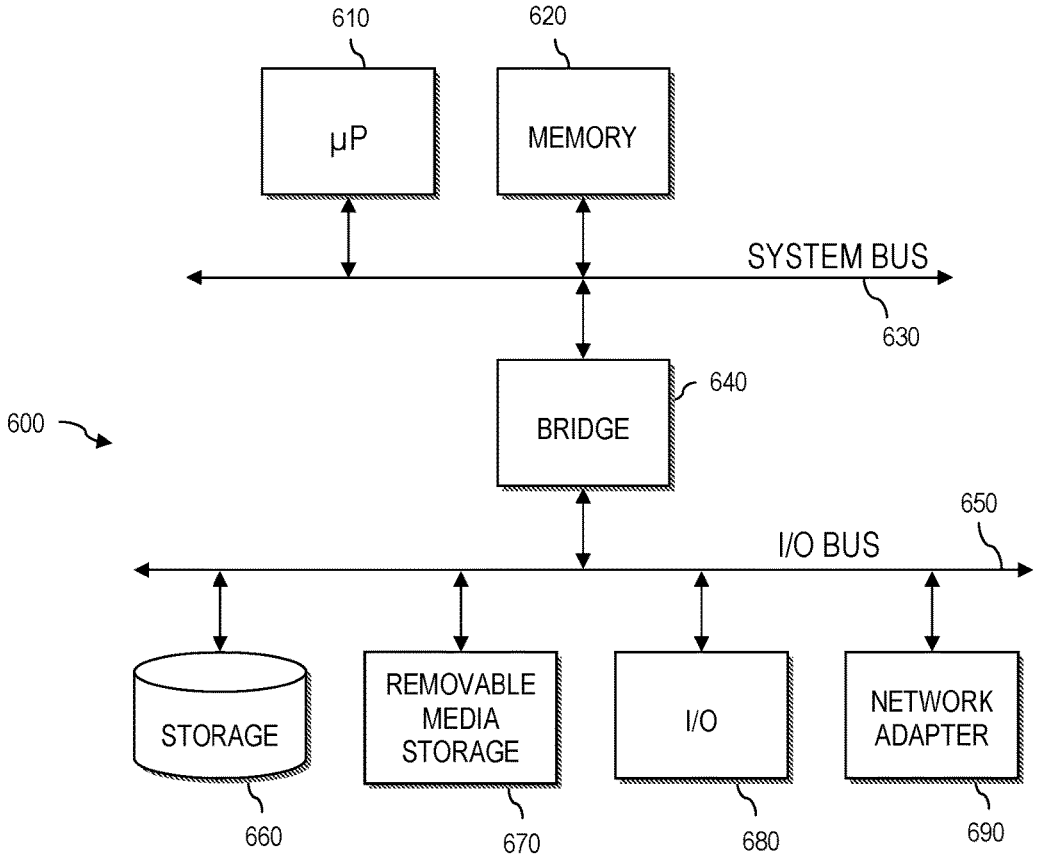
FIG. 6 is a block diagram of a computer system having a computer readable storage medium for implementing functions according to various aspects of the present invention as described in greater detail herein.

Referring to FIG. 6, a block diagram of a data processing system is depicted in accordance with the present invention. Data processing system 600 may comprise a symmetric multiprocessor (SMP) system or other configuration including a plurality of processors 610 connected to system bus 620. Alternatively, a single processor 610 may be employed. Also connected to system bus 620 is memory controller/cache 630, which provides an interface to local memory 640. An I/O bus bridge 650 is connected to the system bus 620 and provides an interface to an I/O bus 660. The I/O bus may be utilized to support one or more buses and corresponding devices 670, such as bus bridges, input output devices (I/O devices), storage, network adapters, etc. Network adapters may also be coupled to the system to enable the data processing system to become coupled to other data processing systems or remote printers or storage devices through intervening private or public networks.

Also connected to the I/O bus may be devices such as a graphics adapter 680, storage 690 and a computer usable storage medium 695 having computer usable program code embodied thereon. The computer usable program code may be executed to implement any aspect of the present invention, for example, to implement any aspect of any of the methods and/or system components illustrated in FIGS. 1-5.

As will be appreciated by one skilled in the art, aspects of the present disclosure may be embodied as a system, method or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable storage medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM), Flash memory, an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device. A computer storage medium does not include propagating signals.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Network using an Network Service Provider).

Aspects of the present disclosure are described herein with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the invention in the form disclosed. Many modifications and variations will be apparent to those of ordinary skill in the art without departing from the scope and spirit of the invention. Aspects of the disclosure were chosen and described in order to best explain the principles of the invention and the practical application, and to enable others of ordinary skill in the art to understand the invention for various embodiments with various modifications as are suited to the particular use contemplated.

What is claimed is:

1. A process for determining a communication status of an environment, the process comprising:

acquiring data about an environment by receiving data from sensors in the environment by receiving data from a global navigation satellite system receiver and monitoring global navigation satellite system frequency bands for noise;

computing a first penalty, with a processor, based on a first subset of the data about the environment, wherein the first penalty is computed using a first algorithm that includes a maximum penalty and a decay rate at which the first penalty decays over time, wherein computing the first penalty includes comparing data associated with the noise detected in the global navigation satellite system frequency bands to an acceptable noise range of the first algorithm, wherein the acceptable noise range of the first algorithm is a previously determined value;

computing a second penalty, with the processor, based on a second subset of the data about the environment, wherein the second penalty is computed using a second algorithm and includes a maximum penalty and a decay rate at which the second penalty decays over time;

compiling, with the processor, the first penalty and the second penalty into an overall environmental penalty that represents a current status of the environment;

comparing, with the processor, the overall environmental penalty to a threshold; and performing an action if the overall environmental penalty exceeds the threshold, wherein the action includes:

determining that an apparatus associated with the process is in a jammed state;

disabling a global navigation satellite system output; and issuing an alarm.

2. The process of claim 1, wherein computing the first penalty comprises:

comparing the first subset of data about the environment to an acceptable range of the first algorithm;

assigning a value based on a first predetermined value and the maximum penalty of the first algorithm to the first penalty if the first subset of data about the environment is outside the acceptable range of the first algorithm; and assigning a value based on the first predetermined value, the decay rate of the first algorithm, and an amount of time that has passed since the first subset of data about the environment was outside the acceptable range of the first algorithm if the first subset of data about the environment is not outside the acceptable range of the first algorithm; and computing the second penalty comprises:

comparing the second subset of data about the environment to an acceptable range of the second algorithm;

assigning a value based on a second predetermined value and the maximum penalty of the second algorithm to the second penalty if the second subset of data about the environment is outside the acceptable range of the second algorithm; and assigning a value based on the second predetermined value, the decay rate of the second algorithm, and an amount of time that has passed since the second subset of data about the environment was outside the acceptable range of the second algorithm if the second subset of data about the environment is not outside the acceptable range of the second algorithm.

3. The process of claim 1, further comprising performing, when the apparatus leaves the jammed state:

disabling the alarm; and enabling the global navigation satellite system output.

4. The process of claim 1, wherein:

computing the first penalty comprises:

computing an entropy of a signal by at least one of the sensors;

determining whether the computed entropy is outside an acceptable entropy range;

assigning a value based on a first predetermined value and the maximum penalty of an entropy algorithm to the first penalty if the computed entropy is outside the acceptable entropy range; and computing the second penalty comprises:

correlating measurement observables of multiple signals from the sensors, wherein the measurement observables include select at least one of phase, Doppler, and power;

determining relative locations of where the signals originated;

determining whether the locations of where the signals originated are outside an acceptable measurement range;

assigning a value based on a second predetermined value and the maximum penalty of a measurement algorithm to the second penalty if the determined relative locations are outside the acceptable measurement range.

5. The process of claim 4, wherein performing an action comprises:

determining that an apparatus associated with the process is in a spoofed state;

disabling a global navigation satellite system output; and issuing an alarm.

6. The process of claim 5, further comprising performing, when the apparatus leaves the spoofed state:

enabling the global navigation satellite system output; and disabling the alarm.

7. The process of claim 1, wherein performing an action comprises sending an alarm over a network to be displayed at a remote location.

8. The process of claim 1, further comprising computing a plurality of penalties;

wherein the overall environmental status is further created by compiling the first penalty, the second penalty, and the plurality of penalties.

9. An apparatus for determining a communication status of an environment, the apparatus comprising:

sensors that gather information about an environment, wherein the sensors include a global navigation satellite system receiver and monitor global navigation satellite system frequency bands for noise; and a processor communicably coupled to the sensors, wherein the processor that performs:

acquiring data about the environment by receiving data from sensors in the environment;

computing a first penalty, with a processor, based on a first subset of the data about the environment, wherein the first penalty is computed using a first algorithm that includes a maximum penalty and a decay rate at which the first penalty decays over time, wherein computing the first penalty comprises comparing data associated with the noise detected in the global navigation satellite system frequency bands to an acceptable noise range of the first algorithm, wherein the acceptable noise range of the first algorithm is a previously determined value;

computing a second penalty, with the processor, based on a second subset of the data about the environment, wherein the second penalty is computed using a second algorithm and includes a maximum penalty and a decay rate at which the second penalty decays over time;

compiling, with the processor, the first penalty and the second penalty into an overall environmental penalty that represents a current status of the environment;

comparing, with the processor, the overall environmental penalty to a threshold; and performing an action if the overall environmental penalty exceeds the threshold, wherein the action includes:

determining that an apparatus associated with the process is in a jammed state;

disabling an output of the global navigation satellite system; and issuing an alarm.

10. The apparatus of claim 9, wherein:

computing the first penalty comprises:

comparing the first subset of data about the environment to an acceptable range of the first algorithm;

assigning a value based on a first predetermined value and the maximum penalty of the first algorithm to the first penalty if the first subset of data about the environment is outside the acceptable range of the first algorithm; and assigning a value based on the first predetermined value, the decay rate of the first algorithm, and an amount of time that has passed since the first subset of data about the environment was outside the acceptable range of the first algorithm if the first subset of data about the environment is not outside the acceptable range of the first algorithm; and computing the second penalty comprises:

comparing the second subset of data about the environment to an acceptable range of the second algorithm;

assigning a value based on a second predetermined value and the maximum penalty of the second algorithm to the second penalty if the second subset of data about the environment is outside the acceptable range of the second algorithm; and assigning a value based on the second predetermined value, the decay rate of the second algorithm, and an amount of time that has passed since the second subset of data about the environment was outside the acceptable range of the second algorithm if the second subset of data about the environment is not outside the acceptable range of the second algorithm.

11. The apparatus of claim 9, wherein the processor, when the apparatus leaves the jammed state, further performs:

disabling the alarm; and enabling the output of the global navigation satellite system.

12. The apparatus of claim 9, wherein:

computing the first penalty comprises:

computing an entropy of a signal by at least one of the sensors;

determining whether the computed entropy is outside an acceptable entropy range;

assigning a value based on a first predetermined value and the maximum penalty of an entropy algorithm to the first penalty if the computed entropy is outside the acceptable entropy range; and computing the second penalty comprises:

correlating measurement observables of multiple signals from the sensors, wherein the measurement observables include select at least one of phase, Doppler, and power;

determining relative locations of where the signals originated;

determining whether the locations of where the signals originated are outside an acceptable measurement range;

assigning a value based on a second predetermined value and the maximum penalty of a measurement algorithm to the second penalty if the determined relative locations are outside the acceptable measurement range.

13. The apparatus of claim 12, wherein performing an action comprises:

determining that an apparatus associated with the process is in a spoofed state;

disabling a global navigation satellite system output; and issuing an alarm.

14. The apparatus of claim 13, wherein the processor, when the apparatus leaves the spoofed state, further performs:

enabling the global navigation satellite system output; and disabling the alarm.

15. The apparatus of claim 9, wherein performing an action comprises sending an alarm over the internet to be displayed at a remote location.

16. The apparatus of claim 9, wherein:

the processor further performs computing a plurality of penalties; and the overall environmental status is further created by compiling the first penalty, the second penalty, and the plurality of penalties.

17. A process for determining a communication status of an environment, the process comprising:

acquiring data about an environment by receiving data from sensors in the environment;

computing a first penalty, with a processor, based on a first subset of the data about the environment, wherein the first penalty is computed using a first algorithm that includes a maximum penalty and a decay rate at which the first penalty decays over time, wherein computing the first penalty comprises:

computing an entropy of a signal by at least one of the sensors;

determining whether the computed entropy is outside an acceptable entropy range;

assigning a value based on a first predetermined value and the maximum penalty of an entropy algorithm to the first penalty if the computed entropy is outside the acceptable entropy range;

computing a second penalty, with the processor, based on a second subset of the data about the environment, wherein the second penalty is computed using a second algorithm and includes a maximum penalty and a decay rate at which the second penalty decays over time, wherein computing the second penalty comprises:

correlating measurement observables of multiple signals from the sensors, wherein the measurement observables include select at least one of phase, Doppler, and power;

determining relative locations of where the signals originated;

determining whether the locations of where the signals originated are outside an acceptable measurement range;

assigning a value based on a second predetermined value and the maximum penalty of a measurement algorithm to the second penalty if the determined relative locations are outside the acceptable measurement range;

compiling, with the processor, the first penalty and the second penalty into an overall environmental penalty that represents a current status of the environment;

comparing, with the processor, the overall environmental penalty to a threshold; and performing an action if the overall environmental penalty exceeds the threshold, wherein the action comprises:

determining that an apparatus associated with the process is in a spoofed state;

disabling a global navigation satellite system output; and issuing an alarm.

* * * * *